United States Patent [19]

Alegria

[11] 4,069,599

[45] Jan. 24, 1978

[54] SHOE PROTECTOR

[76] Inventor: Richard S. Alegria, 912 Arguello St., Apt. 3, Redwood City, Calif. 94063

[21] Appl. No.: 781,926

[22] Filed: Mar. 28, 1977

[51] Int. Cl.[2] ..... A43B 3/18; A43B 13/22

[52] U.S. Cl. ..... 36/7.2; 36/72 R; 36/106

[58] Field of Search ..... 36/72 R, 36/7.2, 50, 51, 106, 9 A

[56] References Cited

U.S. PATENT DOCUMENTS

| | | | |
|---|---|---|---|
| 1,817,623 | 8/1931 | Hervey | 36/9 A |
| 2,062,909 | 12/1936 | Kenagy et al. | 36/9 A |
| 2,276,582 | 3/1942 | Krevis | 36/9 A |
| 3,012,343 | 12/1961 | Dinkel | 36/72 R |

*Primary Examiner*—Patrick D. Lawson
*Attorney, Agent, or Firm*—Russell A. Cannon

[57] ABSTRACT

This article protects the toe-end portion of the shoe upper of a drummer playing a trap set. It is formed from a single sheet of leather and has a flat sole portion that is the same general shape as the sole of the drummer's shoe has a pair of sides and a toe panel extending up at right angles to the sole portion, and has a tongue extending from the toe panel. The forward parts of the sides are cut away from the sole portion, turned in behind the toe panel and attached to the latter. A first pair of straps extend over the tongue to hold it securely against the arch of the drummer's foot. A second pair of straps extends around the heel of the drummer's foot to hold the formed leather piece in place over the forward part of the shoe.

12 Claims, 7 Drawing Figures

SHOE PROTECTOR

BACKGROUND OF INVENTION

This invention relates to a protective covering for the toe of a shoe and more particularly to a covering which is adapted to be detachably applied over the toe of the shoe of a drummer to protect it from being scuffed by the bass drum pedal or the high hat pedal of a trap set.

The percussion player in a small band is responsible for playing several percussion instruments at the same time. As a result, he must use his feet to control the playing of the bass drum and the high hat (cymbals). This is accomplished on the equipment in FIGS. 1 and 2 by pressing a shoe 4 on the pedal 5 which causes a hammer or beater 6 to be moved against the head 7 of a bass drum 8, for example.

There are several techniques employed to accomplish this function. One technique is to press down on the pedal 5 with the sole of the shoe as is shown in FIG. 1. Another technique is to move the toe 9 of the shoe forward along the face of the pedal 5 as pressure is applied to the latter. In this other technique, the toe-upper 9 of the shoe 4 may contact the pedal 5 itself and/or the support member 10 and be scratched thereby. Also, it is desirable for the foot of the percussion player to present a consistent playing surface on the pedal for different pairs of shoes that go with different attires. Of the various types of shoe protectors that have been previously devised for mechanical protection against physical injury to the wearer, for painters, for protection against rain, for babies, for athletes and for motorcycle riders, none of these is believed to be particularly attractive or appropriate for use in this application of protecting the toe-upper of the shoe of a drummer who must appear in public performances.

An object of this invention is the provision of an improved protector article.

DESCRIPTION OF DRAWINGS

This invention will be more fully understood from the following detailed description, together with the drawings in which.

DESCRIPTION OF PREFERRED EMBODIMENTS

Figure 1:
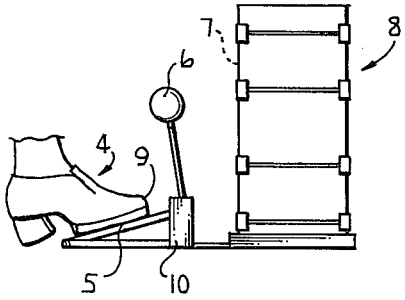
FIGS. 1 and 2 are plan views illustrating techniques of operating the pedal 5 for a bass drum 8.
Figure 2:
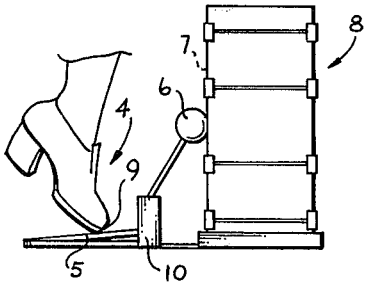
Figure 3:
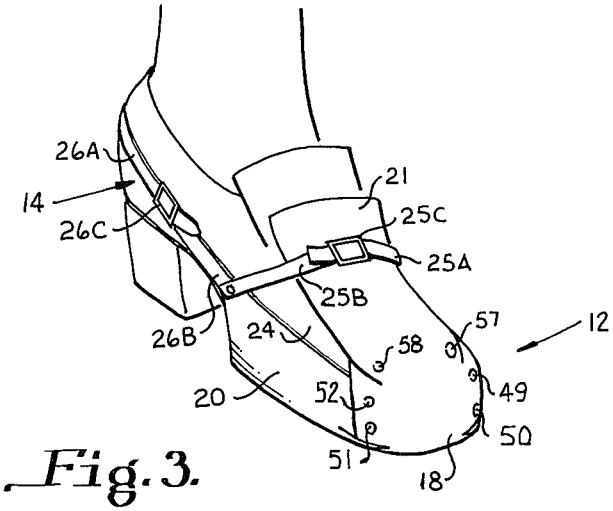
FIG. 3 is a perspective view of a protector 12 embodying this invention.

The protector 12 on a shoe 14 in FIG. 3 may be made from a single sheet 15 (see FIG. 4) of any suitable material such as leather. The material preferred has a smooth surface finish; is relatively firm, although pliable; and is wear resistant. The protector 12 has a full bottom or sole portion 17, a front or toe portion 18, and a pair of sides 19 and 20 which are spaced from the tongue 21 thereof. It is formed to fit snugly and securely over only the front part 24 of the shoe 14 such that it operates as a contiguous part of the shoe itself. A first pair of straps 25A, 25B extends over the instep of the shoe to pull the protector tongue 21 snugly down onto the shoe. A second pair of straps 26A, 26B extends around the heel of the shoe to hold the protector 12 on the shoe.

Figure 4:
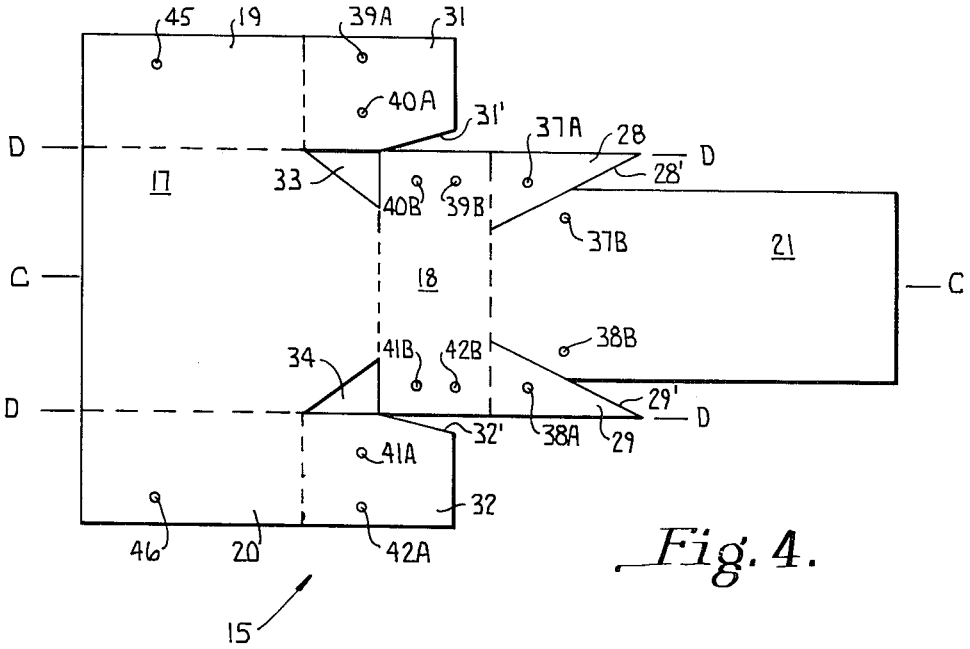
FIG. 4 is a top plan view of a leather piece 15 for forming the protector 12 in FIG. 2.

The sheet 15 of material in FIG. 4 is cut in the symmetrical pattern shown there, about the center line C—C. It comprises the sole portion 17, sides 19 and 20, the toe panel 18, the tongue 21 and a pair of tabs 28 and 29. The front portions 31 and 32 of the sides are cut along the lines D—D to sever the fronts of the sides from the toe panel 18 and the sole 17.

Figure 5:
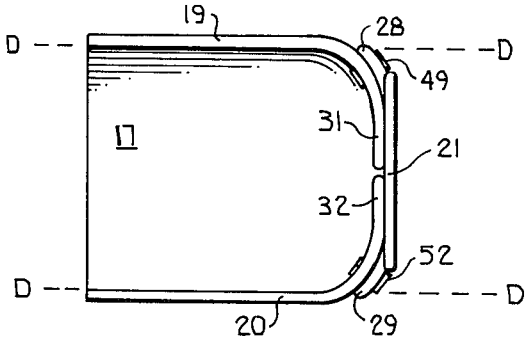
FIG. 5 is a top view of the leather piece in FIG. 4 with the sides 19 and 20 turned up and riveted to the front panel 18.

Triangular sections 33 and 34 are also cut out of the front of the sole 17 to facilitate folding the material as is shown in FIG. 5 and described more fully hereinafter. The edges of the front portions 31 and 32 and of the tabs 28 and 29 which are designated by primed reference numerals are also cut at the angles shown for the same reason. Holes in the sides, front portions, toe panel, tabs and tongue are formed prior to the sheet 15 being folded. The holes 37A and 37B, for example (marked with the same reference numerals and the subscripts A and B), are aligned in the formed and finished protector 12. The sheet 15 with the holes and the pattern in FIG. 4 may be stamped in a single operation. The sheet 15 may be scribed along the dashed lines in FIG. 4 to facilitate forming it into the protector 12 in FIG. 3 if desired, although this operation has not been found to be necessary.

Figure 6:
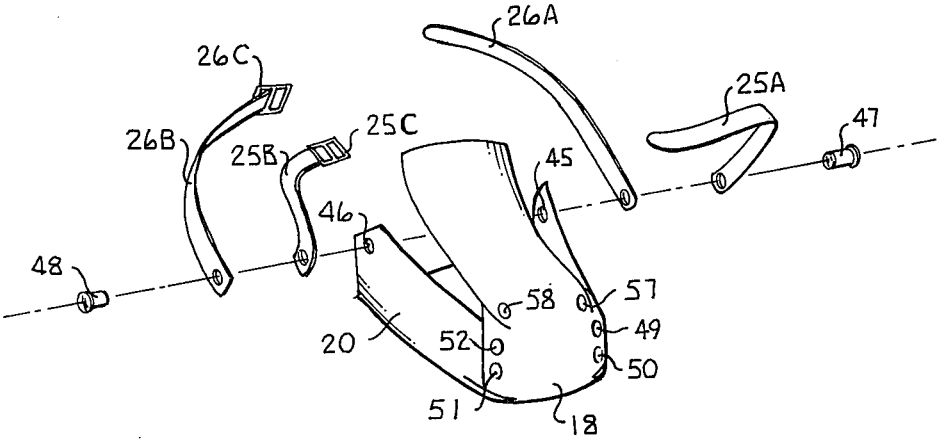
FIG. 6 is an exploded view of the protector 12 showing the straps 25 and 26 to be riveted to the sides 19 and 20.

A finished protector 12 is fabricated by folding the toe portion 18 and sides 19 and 20 up at right angles to the sole 17, with the front portions 31 and 32 behind the toe portion. Corresponding ones of the holes 39–42 are then aligned with rivets 49–52 therein for fastening the sides and toe portions together as shown in FIG. 5. The tabs 28 and 29 are then folded behind the tongue 21, corresponding ones of the holes 37 and 38 being aligned with rivets 57 and 58 located in these holes, to hold the tongue 21 over the sole 17 as is shown in FIG. 6.

Finally, holes in the ends of pairs of straps 25A, 26A and 25B, 26B are aligned with the holes 45 and 46 and attached to the sides by rivets 47 and 48. Buckles 25C and 26C are attached to the instep and heel straps 25B and 26B, respectively. The heel straps 26 enable one to wear the protector on shoes of different sizes. Shoes today typically have different height heels and soles. The adjustable instep straps 25 and the separation of the tongue 21 from the tops of the sides 19 and 20 makes it possible for the protector to be pulled down snugly on shoe 14. It also makes it possible for the same protector 12 to be worn on shoes of different heights.

Figure 7:
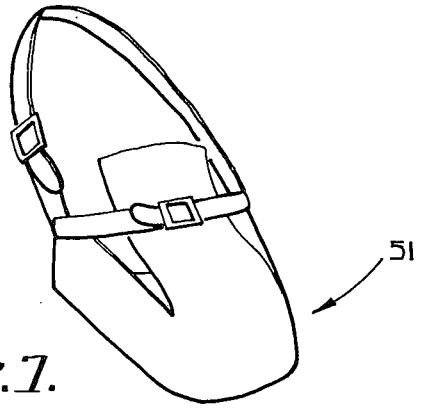
FIG. 7 is a perspective view of an alternate embodiment of this invention.

Although this invention is described in relation to a preferred embodiment thereof, variations and modifications thereof will be apparent to those skilled in the art. By way of example, the front portions 31 and 32 and tabs 28 and 29 may be attached to associated parts of the toe portion 18 and tongue 21 by means other than rivets. These parts may be stitched or stapled together. Alternatively, they may be bonded together with a glue such as epoxy or by heat. Also, a protector may comprise a one-piece part 51 which is molded from plastic, and associated straps (see FIG. 7). The scope of this invention is therefore to be determined from the attached claims rather than the above detailed description.

The heights of sides 19 and 20 are preferably constant over the lengths of the sole 17, and equal to the height of the toe portion 18 which is preferably only slightly greater than the height of the toe of the shoe 14. Also, the height of the toe portion 18 may be greater than that of the sides 19 and 20.

What is claimed is:

1. An article adapted for mounting on a shoe for protecting the toe-end portion of the shoe upper and providing a consistent bottom surface for different shoes, comprising a single sheet of leather-like material having a flat sole portion that is the same shape as at least a major portion of the sole of the shoe forward of the ball of the foot; having a pair of integral side panels extending upward from said sole portion in the same direction and at substantially 90° to said sole portion, the forward portions of said side panels extending beyond the toe end of said sole portion and being severed from the latter over a part of the length thereof; having an integral toe panel extending upward from said sole portion in the same direction as said side panels and at substantially 90° to said sole portion, said forward portions of said side panels being turned in behind said toe panel on the side thereof adjacent to said sole portion; and having an integral tongue portion extending from said toe panel a distance which is greater than the length of said side panels and being adapted to be bent over said sole portion;

said sole portion and said side and toe panels being dimensioned and adapted for fitting around at least the portion of the shoe forward of the ball of the foot;

means securing said forward portions of said side panels to said toe panel; and first and second strap means fastened to said side panels proximate the ends thereof that are opposite to said forward portions thereof;

said first strap means being adapted to extend away from said sole portion and to fit over said tongue portion to hold it securely adjacent the arch of a foot in the shoe on which the protector is mounted;

said second strap means being adapted to extend rearwardly from said side panels and to fit around the heel of the foot for retaining the formed sheet in place over the forward part of the shoe.

2. The protector according to claim 1 wherein the width of said tongue is less than the width of said sole portion.

3. The protector according to claim 2 wherein the tops of said side panels are substantially parallel to said sole portion.

4. The protector according to claim 2 including a tab formed on each of the opposite sides of said tongue adjacent said toe panel, said tabs extending into said tongue by slitting said tongue at angles with respect to a line in said toe panel that is substantially parallel to said sole portion at a height that is substantially equal to the height of said side panels; said tabs being folded in under said tongue on the sides thereof adjacent to said sole portion; and means securing said tabs to said tongue along a given line that is spaced farther from said sole portion than the tops of said side panels for holding said tongue down over said sole portion.

5. The protector according to claim 4 wherein the height of the given line above said sole portion is only slightly greater than the height of the top of the front portion of the shoe that is to be protected.

6. The protector according to claim 5 wherein said sheet of material is leather and said first and second strap means each comprise a pair of leather straps, one strap of each pair being secured to a different one of said side panels, and a buckle attached to a strap of each pair for being selectively attached to an associated other strap.

7. A protector adapted for mounting on a shoe for protecting the toe-end portion of the shoe upper, comprising a hollow body formed of a semi-rigid resilient material and adapted for fitting over the forward portion of the shoe, said body having a flat sole portion that is the same shape as at least the sole portion of the shoe forward of the ball of the foot; having a pair of integral side panels and an integral toe panel, both extending upward from said sole portion in the same parallel directions at substantially 90° to said sole portion, said side and toe panels being adapted to form a continuous flow of material around the sides and front edges of said sole portion; and having a tongue extending from said toe portion back over said sole portion at prescribed distances above said sole portion, the side edges of said tongue and the top edges of said sides being spaced apart over at least a substantial portion of the length of said tongue; and first and second strap means fastened to said side panels at locations opposite said toe panel, said first strap means being adapted for extending over said tongue for holding the latter against the instep of a shoe; said second strap means being adapted for extending around the heel of the shoe.

8. The protector according to claim 7 wherein the length of said tongue measured from said toe portion is greater than the length of said sole portion and said side portions.

9. The protector according to claim 8 wherein the height of said side portions is less than the height of said toe portion.

10. The protector according to claim 8 wherein the width of said tongue is less than the width of said sole portion.

11. The protector according to claim 10 wherein the tops of said side panels are substantially parallel to said sole portion.

12. The protector according to claim 7 wherein said sole and side portions extend forward from approximately one-half way between the arch and the ball of the shoe.

* * * * *